US007140129B2

(12) United States Patent
Newson et al.

(10) Patent No.: US 7,140,129 B2
(45) Date of Patent: Nov. 28, 2006

(54) ARTICLE OF FOOTWEAR WITH PERFORATED COVERING AND REMOVABLE COMPONENTS

(75) Inventors: Marc A. Newson, London (GB); Nicholas Register, London (GB); Damon Clegg, Portland, OR (US); Martin M. Lotti, Beaverton, OR (US); Richard D. Clarke, Portland, OR (US); Stephen Mellor, Portland, OR (US)

(73) Assignee: Nike, Inc., Beaverton, OR (US)

( * ) Notice: Subject to any disclaimer, the term of this patent is extended or adjusted under 35 U.S.C. 154(b) by 246 days.

(21) Appl. No.: 10/787,888

(22) Filed: Feb. 27, 2004

(65) Prior Publication Data

US 2005/0188562 A1 Sep. 1, 2005

(51) Int. Cl.
*A43B 13/12* (2006.01)
*A43B 13/18* (2006.01)

(52) U.S. Cl. ..... 36/100; 36/101; 36/15; 36/3 R

(58) Field of Classification Search ..... 36/3 R, 36/3 A, 15, 100, 31, 101, 44, 10, 55
See application file for complete search history.

(56) References Cited

U.S. PATENT DOCUMENTS

| | | | | | |
|---|---|---|---|---|---|
| 997,657 | A | * | 7/1911 | Drake | 36/129 |
| D94,865 | S | | 3/1935 | Sullivan | |
| D96,093 | S | | 7/1935 | Cohen | |
| D102,122 | S | | 12/1936 | Berman | |
| D103,018 | S | | 2/1937 | Liberty | |
| D103,218 | S | | 2/1937 | Cohen | |
| D103,301 | S | | 2/1937 | Borda | |
| D103,411 | S | | 3/1937 | Sholtz | |
| D102,898 | S | | 7/1937 | Kalmon | |
| D108,320 | S | | 2/1938 | Eldon | |
| 2,119,392 | A | | 5/1938 | Levin | |
| D112,344 | S | | 11/1938 | Lutz | |
| D140,573 | S | | 3/1945 | Sandler | |
| 2,433,329 | A | * | 12/1947 | Adler et al. | 36/81 |
| 4,372,057 | A | * | 2/1983 | Nielsen | 36/10 |
| D283,173 | S | | 4/1986 | Malone | |
| 4,747,220 | A | * | 5/1988 | Autry et al. | 36/59 R |
| 4,920,666 | A | * | 5/1990 | Marega | 36/117.1 |

(Continued)

FOREIGN PATENT DOCUMENTS

DE 2255628 A1 5/1974

(Continued)

OTHER PUBLICATIONS

Nike Footwear Catalog Holiday 1994, p. 64, published Mar. 1994.

(Continued)

*Primary Examiner*—Marie Patterson
(74) *Attorney, Agent, or Firm*—Banner & Witcoff, Ltd.

(57) ABSTRACT

An article of footwear includes a flexible cover shaped to envelope at least a portion of a wearer's foot. The cover has a sole region with inner and outer surfaces, the inner surface positioned to face the sole of the wearer's foot and the outer surface positioned to face in an opposite direction. The cover also has a plurality of apertures formed in the sole region. The article further includes a removable outsole nested within the cover. The outsole has an upper surface positioned to face the sole of the wearer's foot, a lower surface facing the inner surface of the cover sole region, and a plurality of lugs on the lower surface which protrude into the plurality of apertures.

18 Claims, 21 Drawing Sheets

U.S. PATENT DOCUMENTS

| | | | | |
|---|---|---|---|---|
| D333,032 | S | 2/1993 | Hatfield | |
| D336,148 | S | 6/1993 | Adams | |
| D345,458 | S | 3/1994 | Lacoraza et al. | |
| 5,367,791 | A * | 11/1994 | Gross et al. | 36/31 |
| D398,761 | S | 9/1998 | Smith, III | |
| D398,766 | S | 9/1998 | Avar | |
| 5,802,740 | A * | 9/1998 | Merk, Sr. | 36/55 |
| D407,550 | S | 4/1999 | Clarke | |
| D412,776 | S | 8/1999 | Biedermann | |
| D415,879 | S | 11/1999 | Lupo | |
| 6,023,859 | A * | 2/2000 | Burke et al. | 36/105 |
| D432,781 | S | 10/2000 | Hardy | |
| D440,034 | S | 4/2001 | Matis | |
| D447,618 | S | 9/2001 | Matis et al. | |
| D448,148 | S | 9/2001 | Matis et al. | |
| D452,067 | S | 12/2001 | Matis et al. | |
| D471,350 | S | 3/2003 | Roulo | |
| 6,564,475 | B1 * | 5/2003 | Collins et al. | 36/3 R |
| D476,145 | S | 6/2003 | Adams et al. | |
| D480,545 | S | 10/2003 | Matis et al. | |
| D480,548 | S | 10/2003 | Matis et al. | |
| D486,627 | S | 2/2004 | Rogers et al. | |
| D487,619 | S | 3/2004 | Matis | |
| D496,152 | S | 9/2004 | Doxey | |
| D498,044 | S | 11/2004 | Morris | |
| D498,583 | S | 11/2004 | Yun | |
| D499,875 | S | 12/2004 | Lozano | |
| 6,915,596 | B1 * | 7/2005 | Grove et al. | 36/100 |
| 2001/0025432 | A1 * | 10/2001 | Contreras et al. | 36/3 R |
| 2003/0088996 | A1 | 5/2003 | Hall | |
| 2003/0093919 | A1 * | 5/2003 | Wang | 36/10 |
| 2005/0066544 | A1 * | 3/2005 | Beak | 36/43 |

FOREIGN PATENT DOCUMENTS

| | | | |
|---|---|---|---|
| EP | 1369048 | A | 12/2003 |

OTHER PUBLICATIONS

Nike Footwear Catalog Fall 1996, p. 188, published Dec. 1995.
Nike Footwear Catalog Fall 1999, p. W105, published Nov. 1998.
Nike Footwear Catalog Holiday 2000, p. W52, published Mar. 2000.
Nike Footwear Catalog Spring 2001, p. M38, published Jun. 2000.
Nike Footwear Catalog Spring 2001, p. M122, published Jun. 2000.
Nike Footwear Catalog Late Spring 2001, p. M6, published Sep. 2000.
Nike Footwear Catalog Holiday 2002, p. M9, published Mar. 2002.
Nike Footwear Catalog Holiday 2002, p. M21, published Mar. 2002.
Nike Footwear Catalog Late Spring 2003, p. W4, published Sep. 2002.
Nike Footwear Catalog Late Spring 2003, p. W19, published Sep. 2002.
Nike Footwear Catalog Late Spring 2003, p. W49, published Sep. 2002.
Nike Footwear Catalog Fall 2003, p. W59, published Nov. 2002.
Nike Footwear Catalog Holiday 2003, p. W47, published Mar. 2003.

* cited by examiner

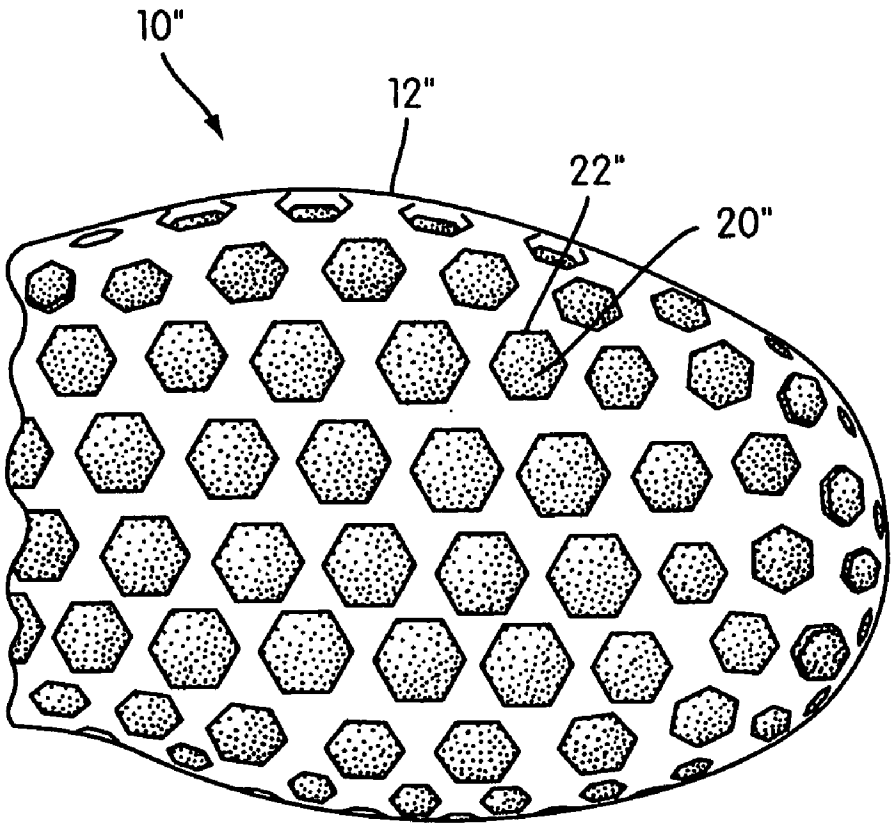
FIG. 20
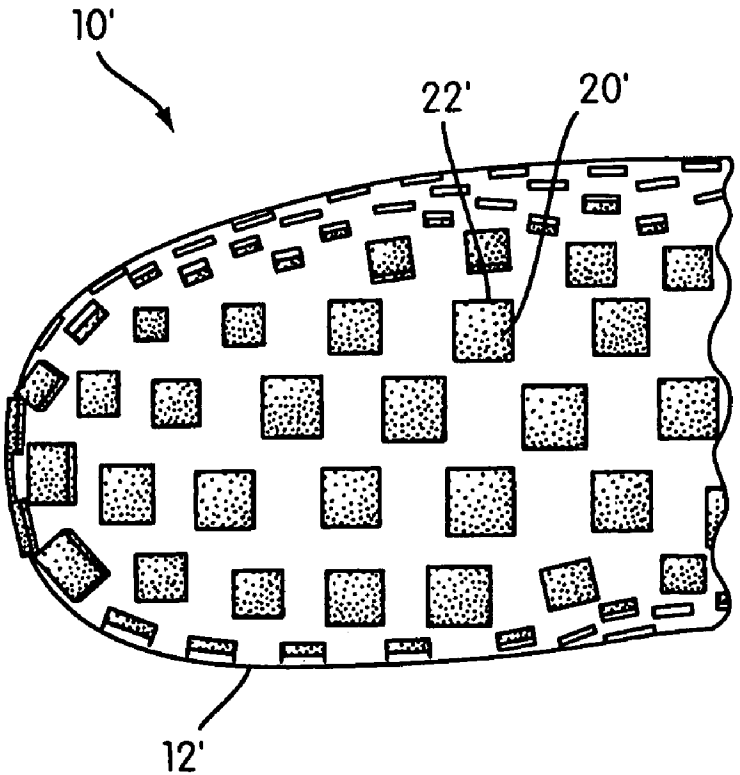

ARTICLE OF FOOTWEAR WITH PERFORATED COVERING AND REMOVABLE COMPONENTS

FIELD OF THE INVENTION

This invention relates to an article of footwear. In particular, this invention relates to an article of footwear having multiple components which can be removed or replaced as desired.

BACKGROUND OF THE INVENTION

Footwear often serves a functional role related to a particular activity. One of the most well-known examples of footwear function is protection of a wearer's feet from the external environment. In particular, people wear shoes to protect the bottoms of their feet from the surface over which they walk. Footwear may also provide added traction as a wearer walks, support for a wearer's foot, warmth, etc. Footwear often serves these and other functions in varying degrees. For example, a person may need a relatively rugged shoe when walking outside, but only need a light slipper when walking inside.

Because of the many functions that footwear serves, people often have multiple pairs of shoes designed for use in different circumstances. This is can be inconvenient. If a person expects to encounter various environments for which different shoe types may be appropriate, that person may be forced to carry one or more pairs of shoes in addition to the shoes he or she may presently be wearing.

As in many fields, manufacturing presents many challenges in the footwear arts. As indicated above, a shoe often needs a rugged surface in the outsole region so as to support the wearer's foot, to provide traction and/or for durability. However, it is frequently desirable that other parts of a shoe be softer and more compliant. Because of these different requirements, shoes are often fabricated from multiple types of materials. These diverse materials are usually joined in some manner, e.g., stitching, gluing, etc. Joining different component types often requires additional manufacturing steps. Reducing the number of joining operations reduces manufacturing steps, thereby reducing cost.

Disposal of worn-out shoes is another challenge in the footwear arts. At the end of a shoe's life cycle, joined components must often be separated. In particular, the different materials used to construct a shoe often have differing recycling requirements. Separating components that have been glued, stitched or otherwise bonded adds to the inconvenience and expense of recycling. When recycling is not convenient, some persons will simply dispose of shoes with non-recycled refuse. If a shoe could be more easily separated into components, people will be encouraged to recycle that shoe.

SUMMARY OF THE INVENTION

The present invention addresses the above and other challenges. In at least one embodiment, the invention includes a shoe having several components. The wearer may separate these components and then recombine some or all of these components as desired. In one embodiment, the invention includes an article configured for placement on a foot of a human wearer. The article includes a flexible cover shaped to envelope at least a portion of the wearer's foot. The cover has a sole region with opposing inner and outer surfaces, with the inner surface positioned to face the sole of the wearer's foot. The cover also has a plurality of apertures formed in the sole region. The article further includes a removable outsole nested within the cover. The outsole has opposing upper and lower surfaces, with the lower surface facing the inner sole region surface. The outsole also has a plurality of lugs on the lower surface that protrude into the plurality of apertures.

In another embodiment, the invention also includes an article configured to be placed on the foot of a human wearer. This embodiment also includes a flexible cover shaped to envelope at least a portion of the foot and having a sole region. The cover further has an upper region attached to the sole region and positioned to cover at least a portion of the top and sides of the foot. A plurality of apertures are formed in the sole and upper regions. The embodiment includes a removable outsole nested within the cover and having opposing upper and lower surfaces, as well as a plurality of lugs on the lower surface which protrude into a portion of the plurality of apertures in the cover. The embodiment further includes a removable slipper nested within the cover and having a sole and an upper, the slipper sole facing the upper outsole surface.

These and other features and advantages of the present invention will be readily apparent and fully understood from the following detailed description of preferred embodiments, taken in connection with the appended drawings.

BRIEF DESCRIPTION OF THE DRAWINGS

The foregoing summary of the invention, as well as the following detailed description of preferred embodiments, is better understood when read in conjunction with the accompanying drawings, which are included by way of example, and not by way of limitation with regard to the claimed invention.

FIG. 20 is a split view showing two alternate embodiments of the invention.

DETAILED DESCRIPTION OF THE PREFERRED EMBODIMENTS

Embodiments of the invention address many of the challenges discussed above. In at least one embodiment, the invention includes a shoe having multiple components that are separable by the wearer. The wearer may then combine some or all of these components as the wearer chooses. In one embodiment, the shoe has a one-piece flexible outer covering that surrounds a wearer's foot and removably contains other shoe components. One of those components is an outsole, which slips inside the covering and rests in a sole region of the covering. An inner slipper component also fits within the covering, and rests upon the outsole. An insole component may also be inserted inside the covering, either within the slipper or between the slipper and the outsole.

Figure 1:
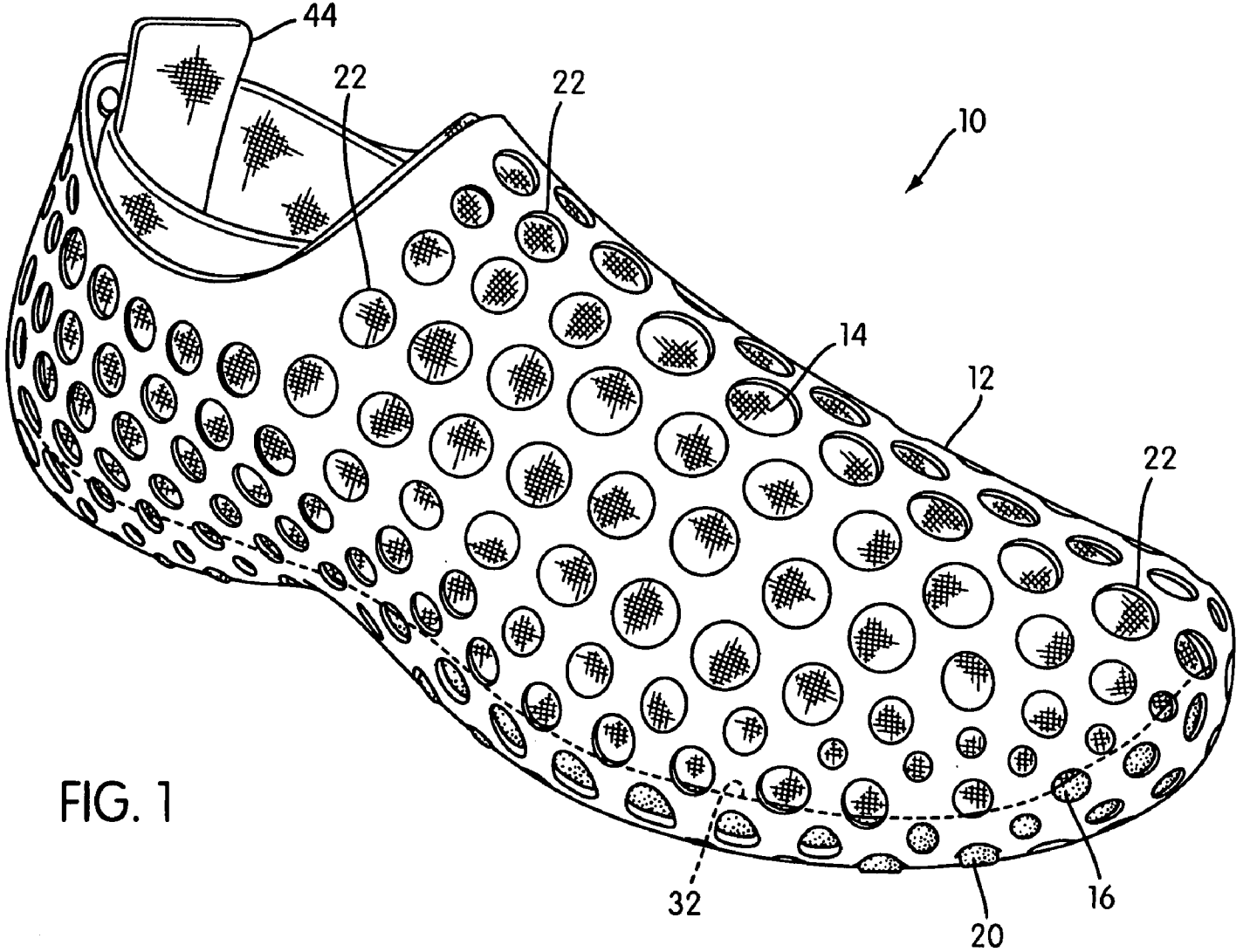
FIG. 1 is an upper perspective view of an assembled shoe according to at least one embodiment of the invention.

FIG. 1 is a perspective upper view of an assembled shoe 10 according to at least one embodiment of the invention. Shoe 10 is a right shoe (i.e., shaped for the right foot of a wearer). A left shoe according to the embodiment of FIG. 1 would be substantially similar, but instead shaped for a wearer's left foot. Shoe 10 includes a one-piece perforated outer covering (or "cage") 12. Cage 12 generally surrounds the wearer's foot below the ankle, and has numerous apertures 22 formed in the cage surface. Contained within cage 12 is a slipper 14. Interposed between slipper 14 and cage 12 is an outsole 16. Outsole 16 is only slightly visible in FIG. 1, but is more clearly visible in subsequent figures. Outsole 16 further includes a plurality of lugs 20 that protrude through apertures 22 in the lower portion of cage 12. Although not visible in FIG. 1, shoe 10 also includes an insole 18. Insole 18, which can be located between slipper 14 and outsole 16, or entirely within slipper 14, is described in more detail below and in FIGS. 9, 11, 18, 18A, 19 and 19A.

To facilitate understanding of the invention, different types of shading are used for various components of shoe 10 in the drawings. In particular, cage 12 is shown throughout the drawings without shading. Slipper 14 is shown throughout the drawings with a mesh pattern such as is sometimes used in other contexts to indicate a fabric surface. Outsole 16 is shown throughout the drawings with stippling. The stippling and mesh shading are added for purposes of more clearly distinguishing between components in the figures. The shading is not intended to imply limitation upon the surface texture of, or on the material that may be used to fabricate, any of these components.

Figure 2:
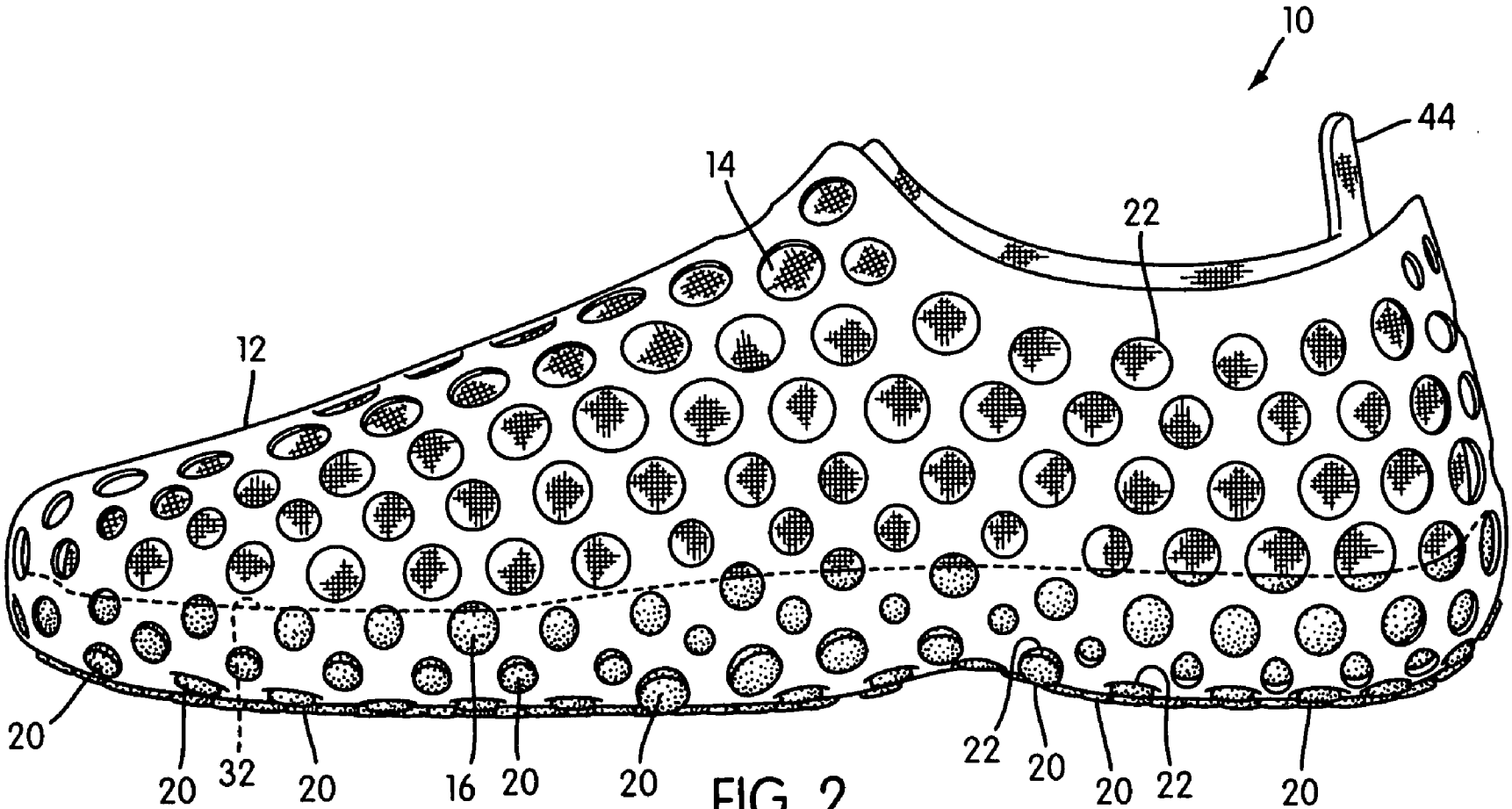
FIG. 2 is a medial side view of the assembled shoe of FIG. 1.
Figure 3:
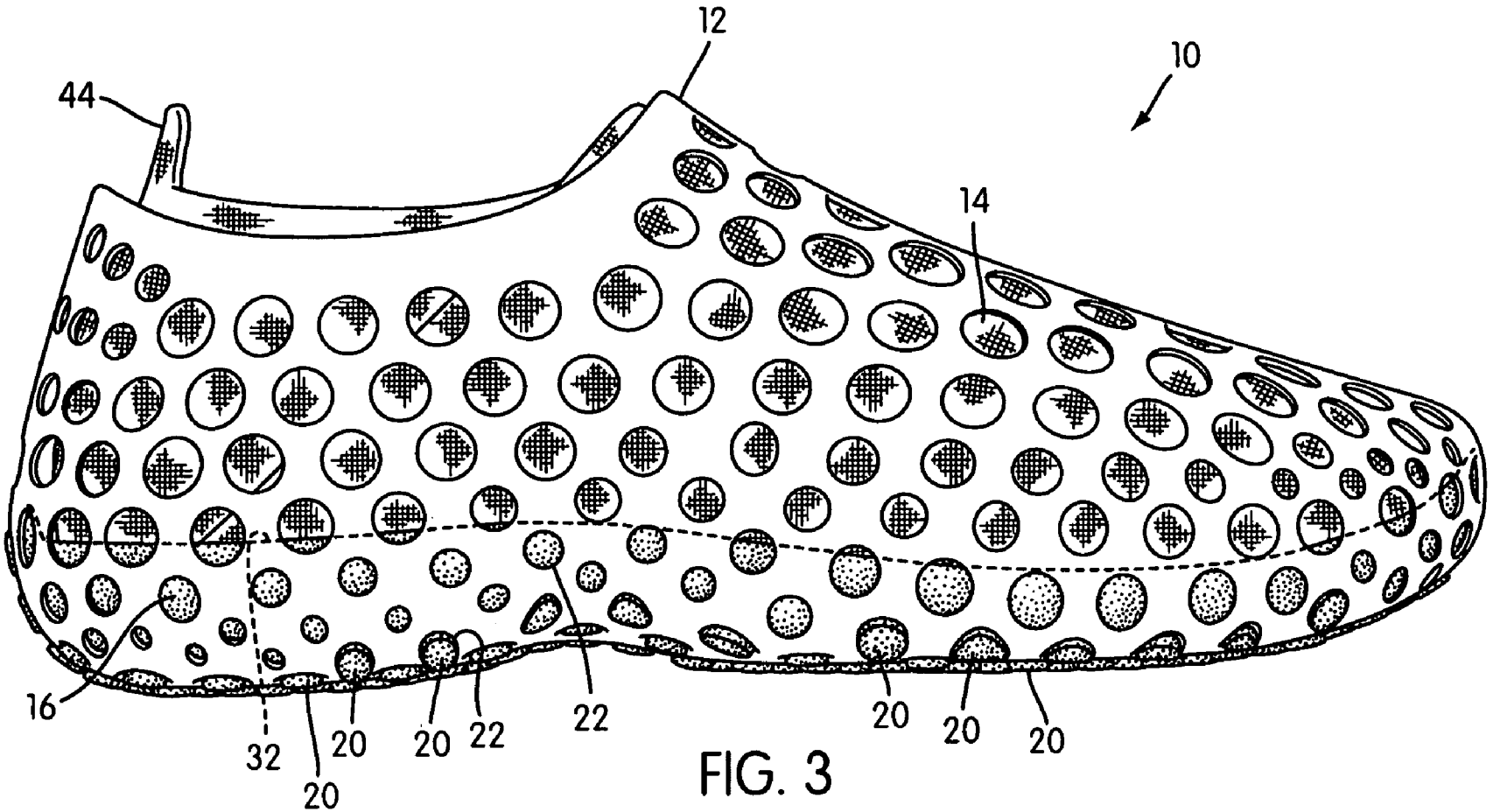
FIG. 3 is a lateral side view of the assembled shoe of FIG. 1.
Figure 5:
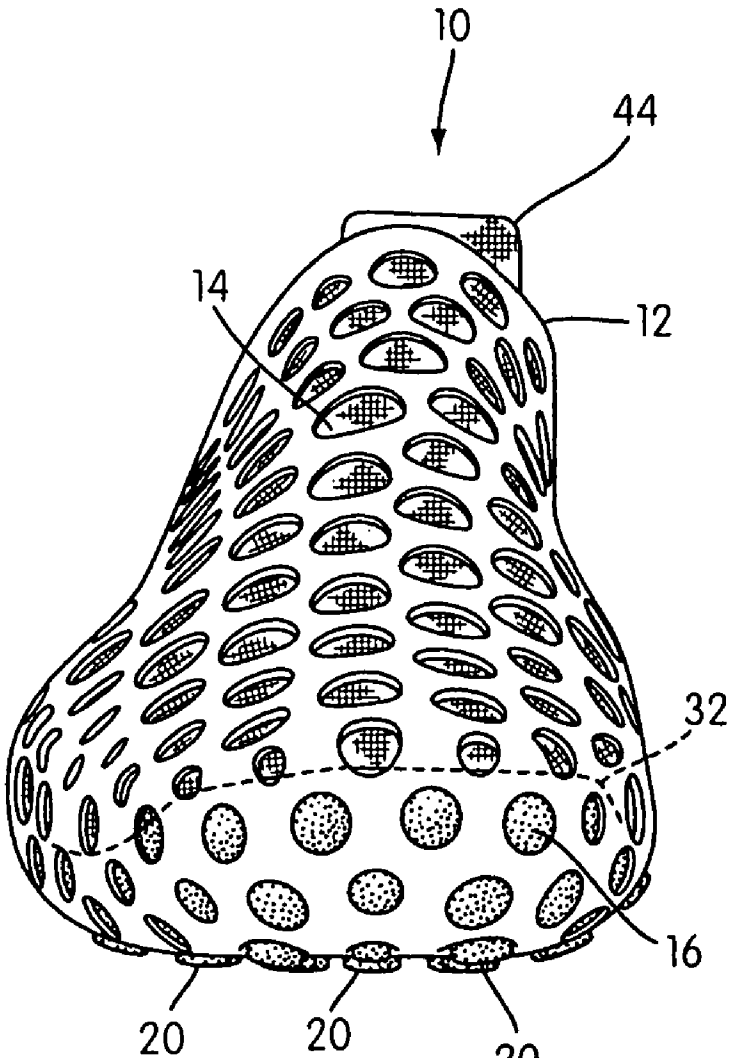
FIG. 5 is a front side view of the assembled shoe of FIG. 1
Figure 4:
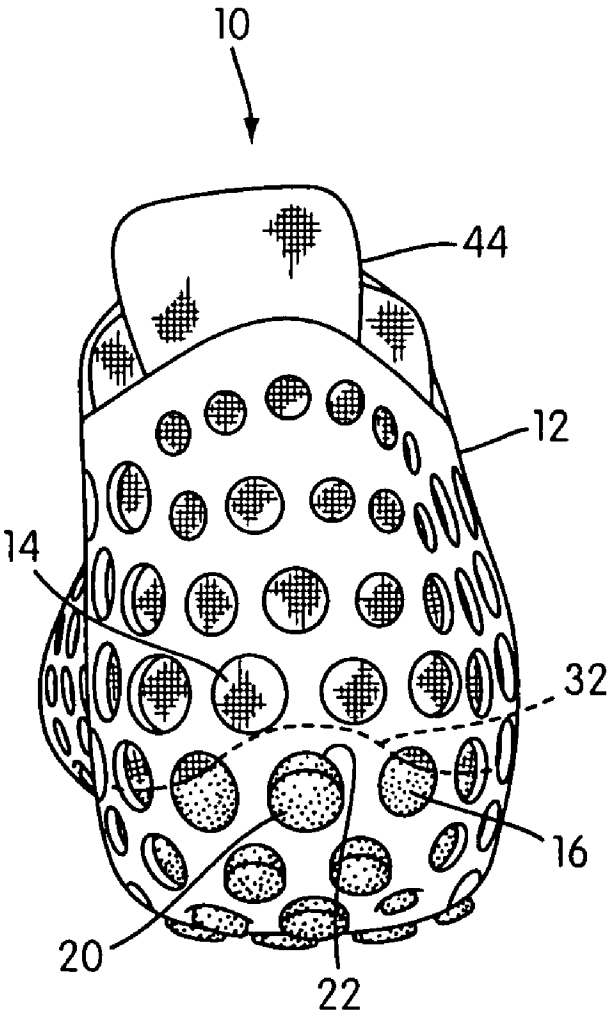
FIG. 4 is a rear side view of the assembled shoe of FIG. 1.
Figure 6:
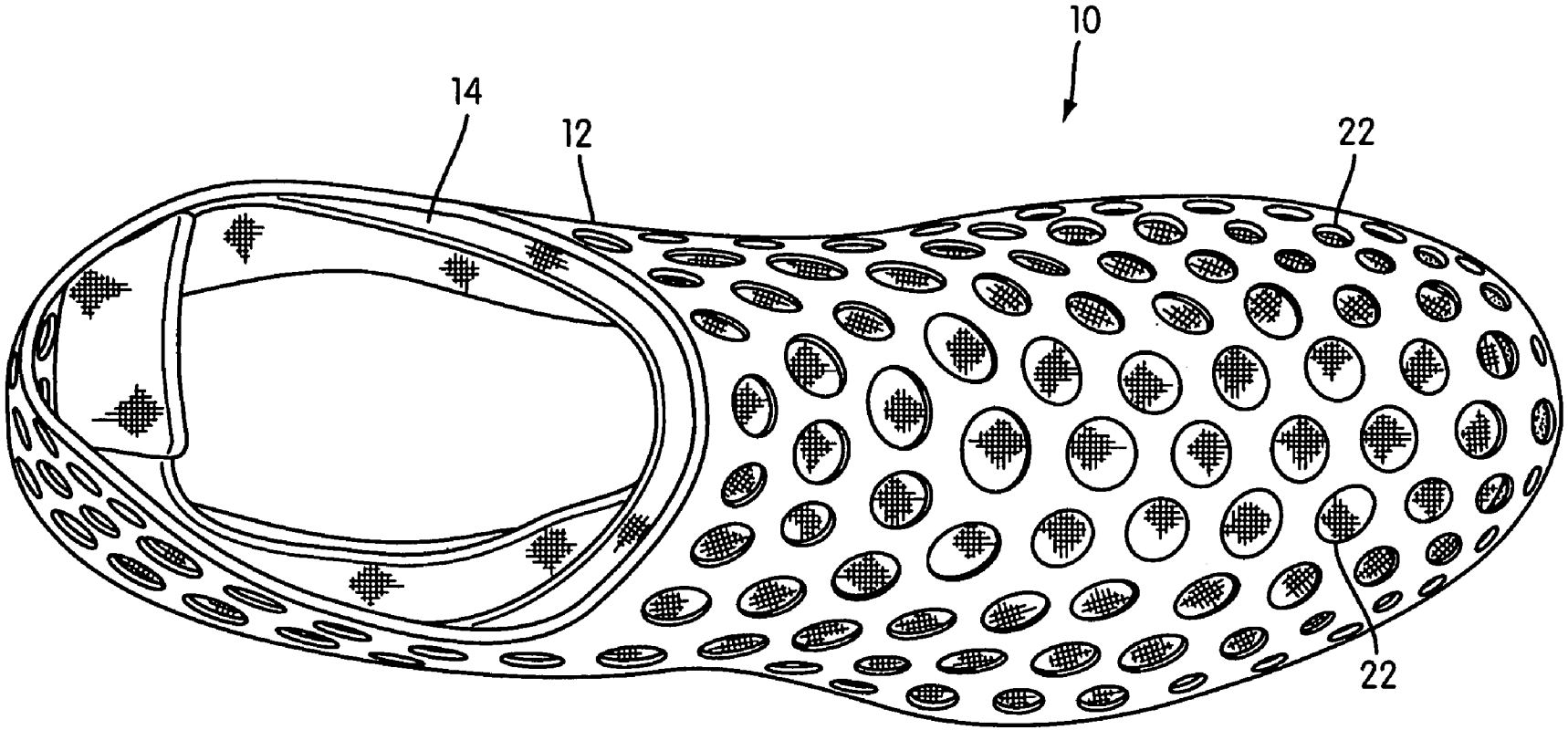
FIG. 6 is a top view of the assembled shoe of FIG. 1.
Figure 7:
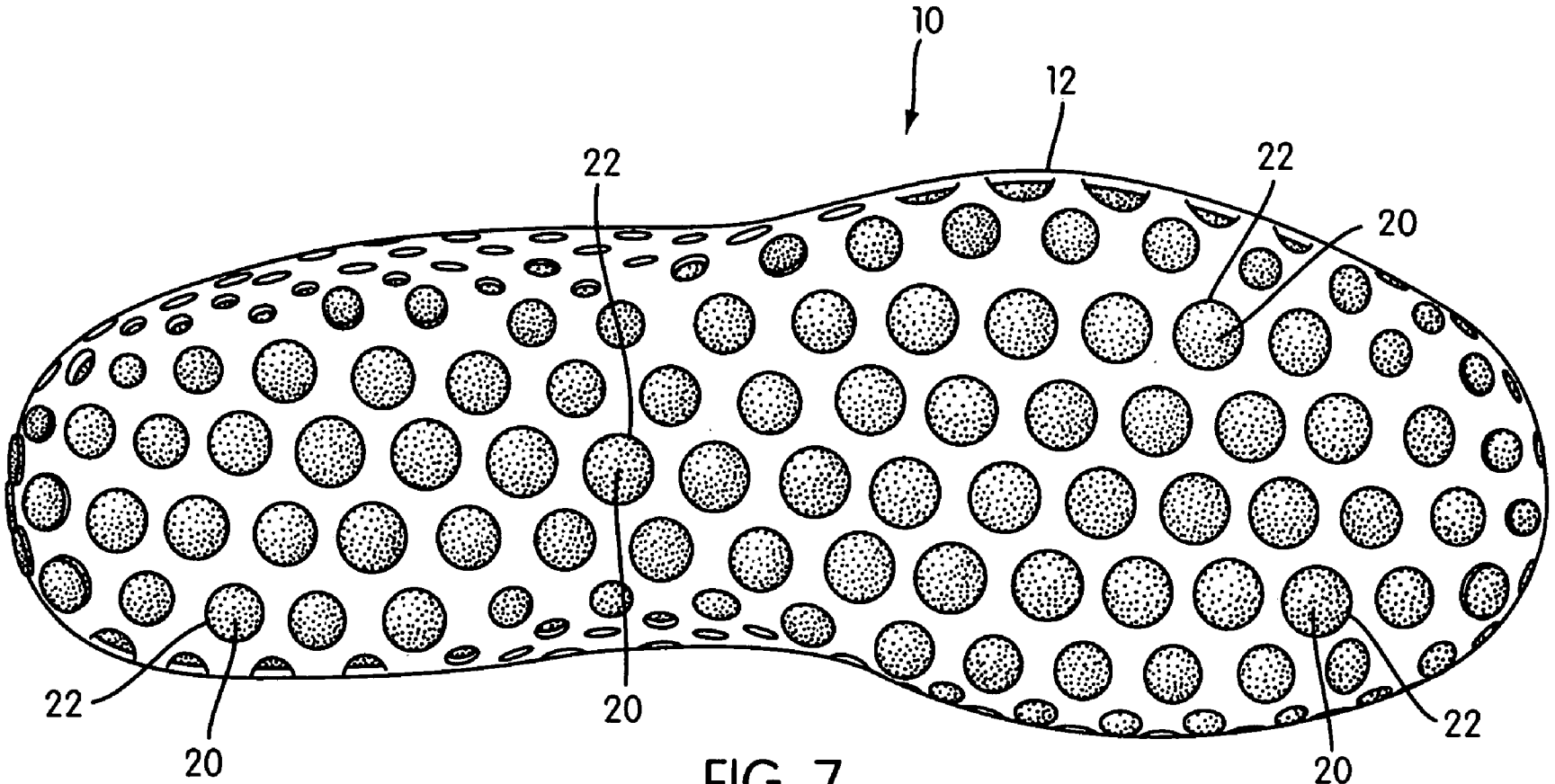
FIG. 7 is a bottom view of the assembled shoe of FIG. 1.

FIG. 2 is a medial side view of the shoe of FIG. 1. As partially seen in FIG. 2, outsole 16 (at least in the embodiment shown) rises slightly up the edges of a wearer's foot. The upper edges of outsole lip 32 (described in connection with FIG. 9) are shown as hidden lines in portions of FIGS. 1–5 and 15. FIG. 3 is a lateral side view of shoe 10. FIGS. 4 and 5 are rear and front views of shoe 10, respectively. FIG. 6 is a top view of shoe 10 showing the inner sole surface of slipper 14 in the heel region. As explained in more detail below, shoe 10 may alternately be configured such that insole 18 rests within slipper 14. FIG. 7 is a bottom view of shoe 10 showing lugs 20 protruding through apertures 22 in the sole of cage 12.

Figure 8:
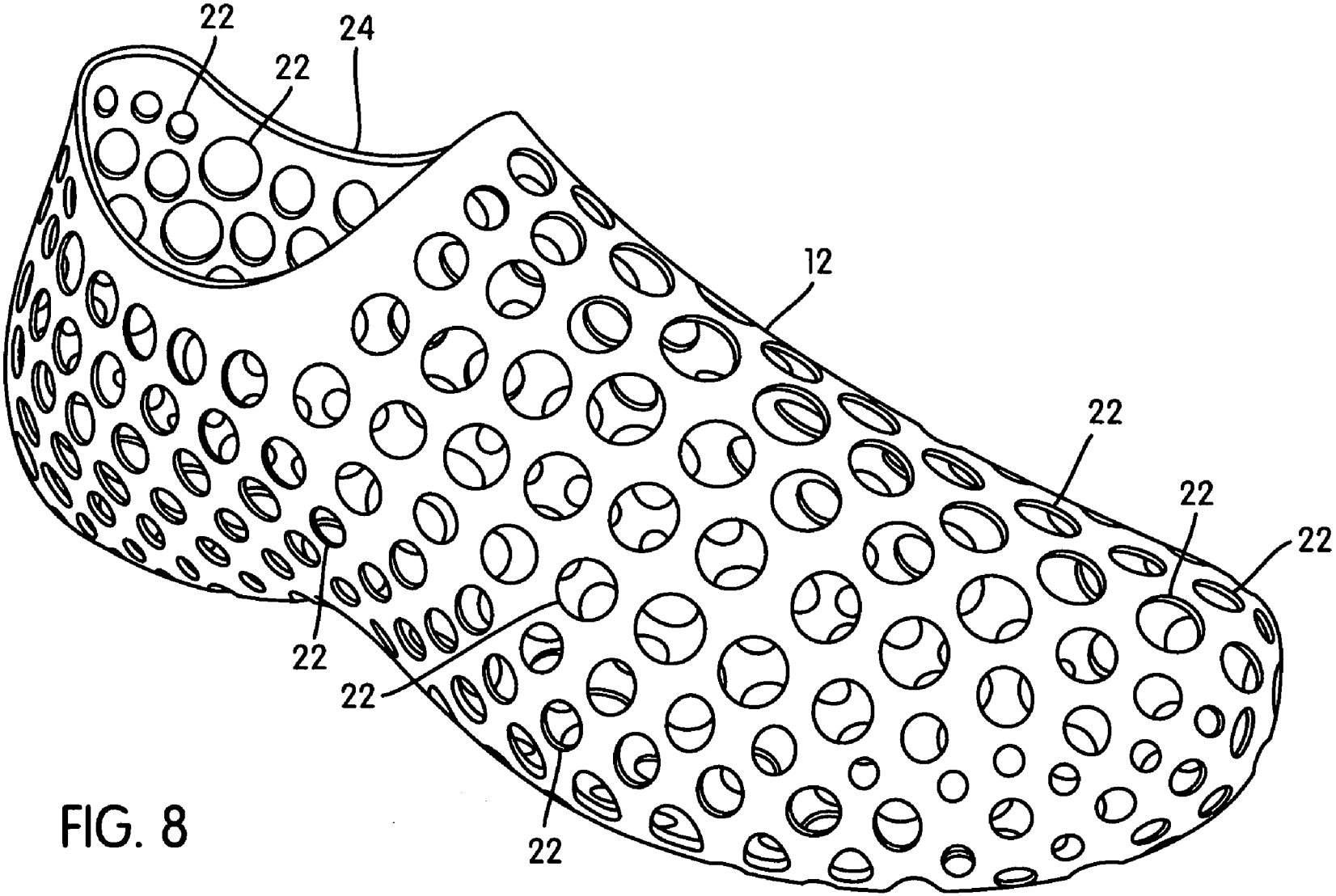
FIG. 8 is an upper perspective view of the cage component of the shoe of FIG. 1.
Figure 14:
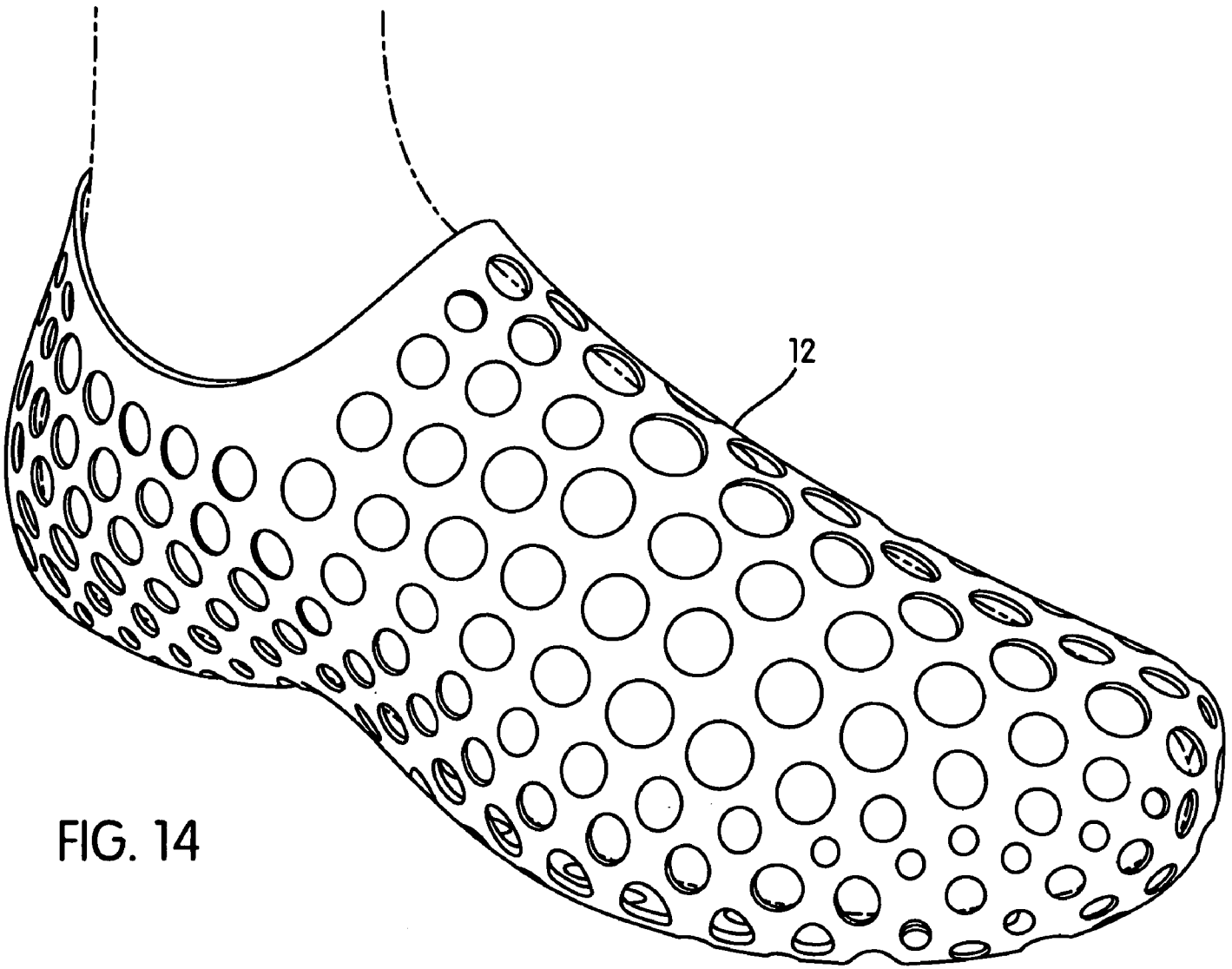
FIG. 14 is an upper perspective view of the cage component of the shoe of FIG. 1, with a wearer's foot shown in broken lines.
Figure 15:
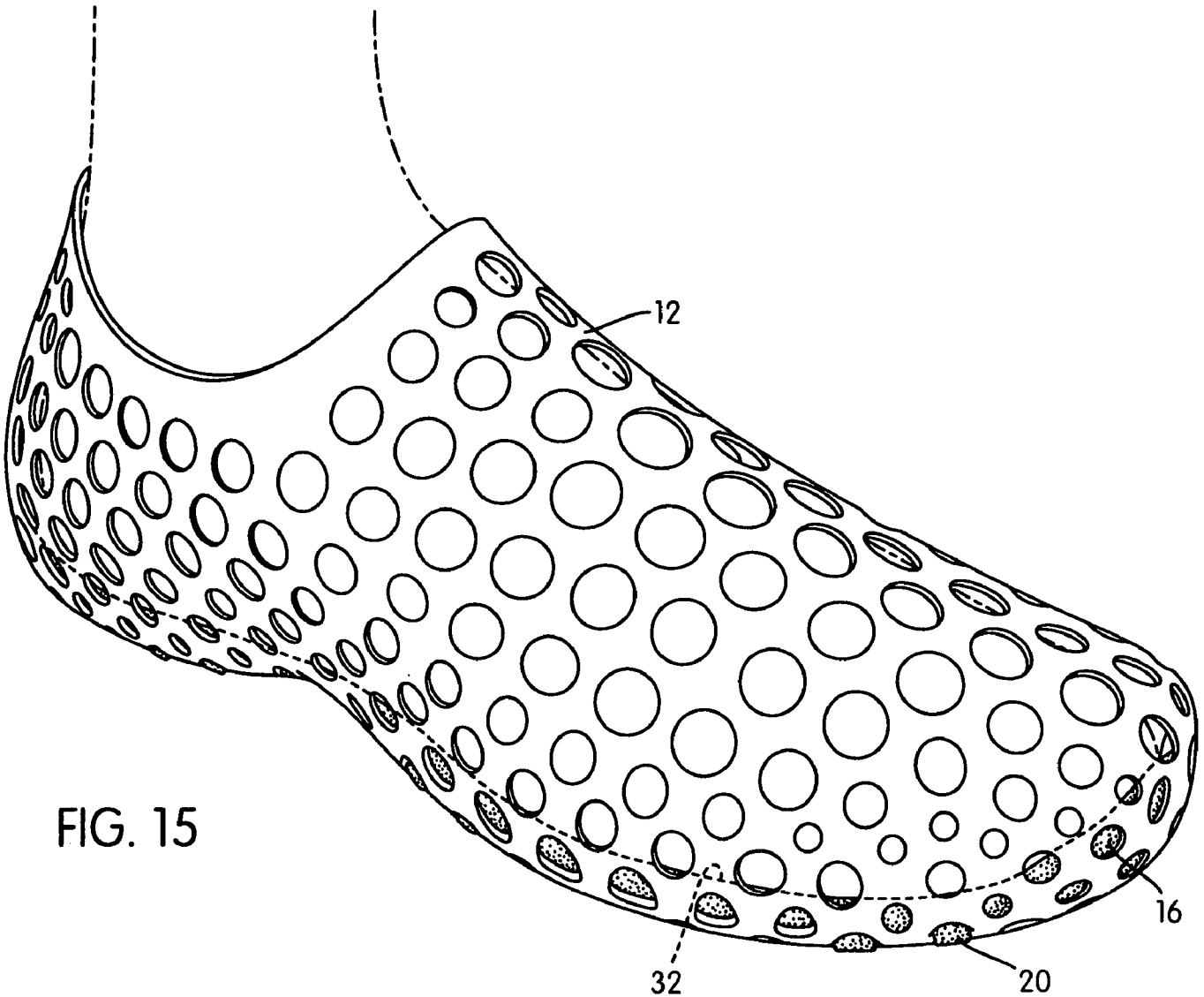
FIG. 15 is an upper perspective view of the cage and outsole components of the shoe of FIG. 1, with a wearer's foot shown in broken lines.
Figure 17:
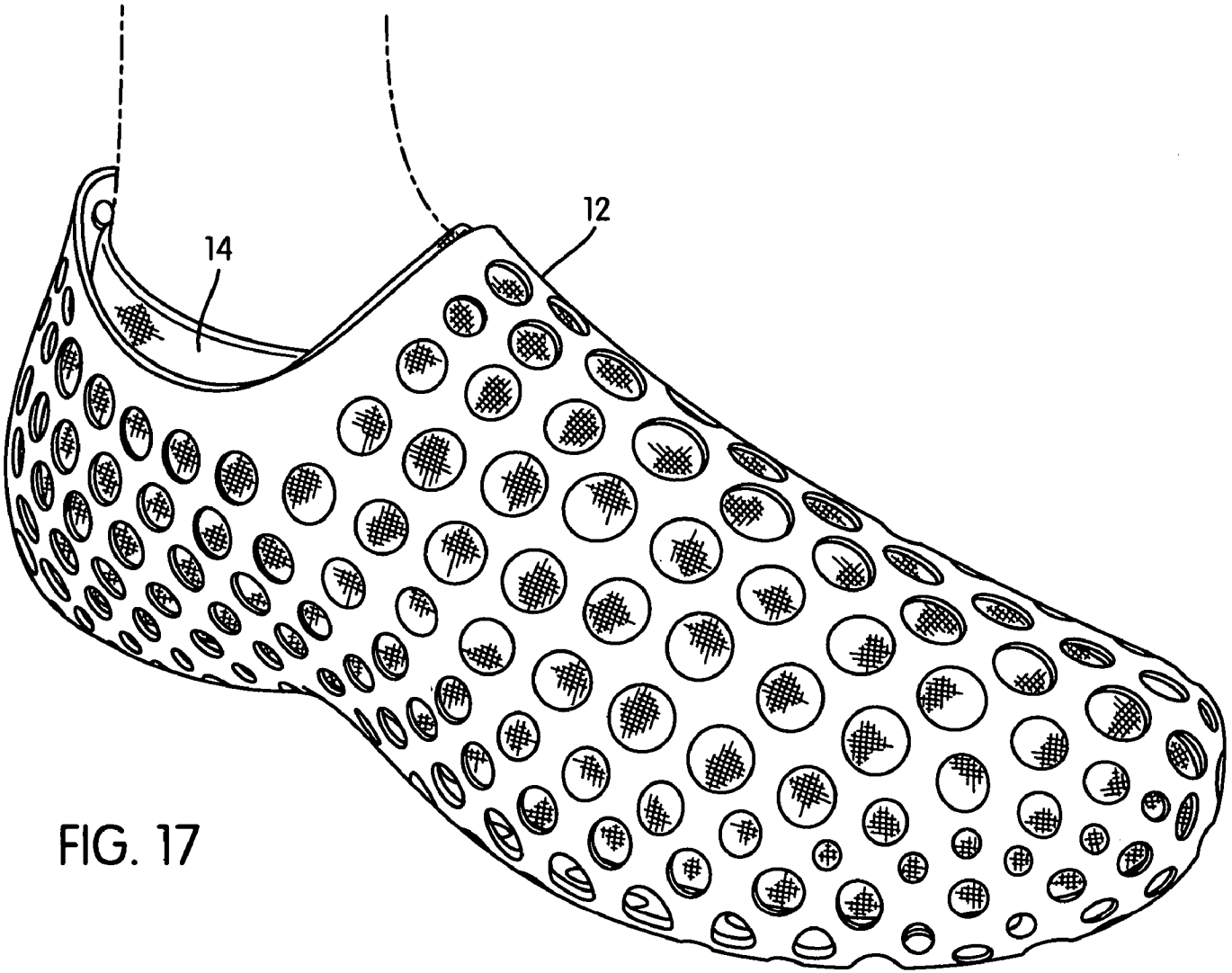
FIG. 17 is an upper perspective view of the cage and slipper components of the shoe of FIG. 1, with a wearer's foot shown in broken lines.

FIG. 8 is a perspective view of cage 12 only (i.e., without outsole 16, insole 18 or slipper 14). Cage 12 snugly but comfortably holds a wearer's foot within shoe 10. In at least some embodiments, and as shown in FIGS. 14, 15 and 17, cage 12 fully surrounds a wearer's foot except for a foot opening. As discussed in more detail below, selected components of shoe 10 may be combined into various configurations in which less than all of the components are used. In several of these configurations, cage 12 serves to hold the components together. For example, when cage 12 is worn with outsole 16 (and without slipper 14) as shown in FIG. 15, cage 12 holds outsole 16 against the sole of the wearer's foot.

In at least some embodiments, cage 12 is a formed from a material which is sufficiently flexible to permit cage 12 to slip over a wearer's foot, yet sufficiently durable to withstand repeated contact with a hard surface over which a wearer may walk. In at least one embodiment, cage 12 is molded from thermoplastic polyurethane (e.g., DESMOPAN 9370 AU available from Bayer Corporation of Pittsburgh, Pa.). In some embodiments, the sole region of cage 12 is slightly thicker than the upper region (i.e., the portion of cage 12 covering the sides and top of a wearer's foot). In one embodiment, cage 12 has a thickness ranging from about 1.5 mm to about 2.0 mm in the side and upper regions, and a thickness of about 2.0 mm to about 2.5 mm in the sole region. The thickness(es) of cage 12 varies in other embodiments. In the embodiment shown, cage 12 has circular apertures 22 formed over most of its surface. In at least some embodiments, the size of the apertures ranges from about 5.0 mm in diameter to about 15.0 mm in diameter. In other embodiments, the diameters of the apertures range from about 4.5 mm to about 13.5 mm, while in other embodiments the diameters of the apertures range from about 5.5 mm to about 16.5 mm. Still other embodiments may have other sized apertures. In various embodiments, the sole region of cage 12 has between about 90 and about 95 apertures. In other embodiments, cage 12 may have about 80 to about 86 apertures in the sole region, while other embodiments may have about 99 to about 105 apertures in the sole region. Still other embodiments may have other numbers of sole region apertures. Similarly, the upper region of cage 12 has between about 230 and about 235 apertures in various embodiments. In other embodiments, cage 12 may have about 207 to about 212 apertures in the upper region, while still other embodiments may have about 253 to about 259 apertures in the upper region. Yet other embodiments may have other numbers of upper region apertures. In some embodiments, and as shown in FIG. 8, the number of apertures is reduced in the region near ankle collar 24. In other embodiments, cage 12 may only have apertures formed in some or all of the sole region, in the sole region and some or all of the upper region, or in other combinations of locations.

Figure 9:
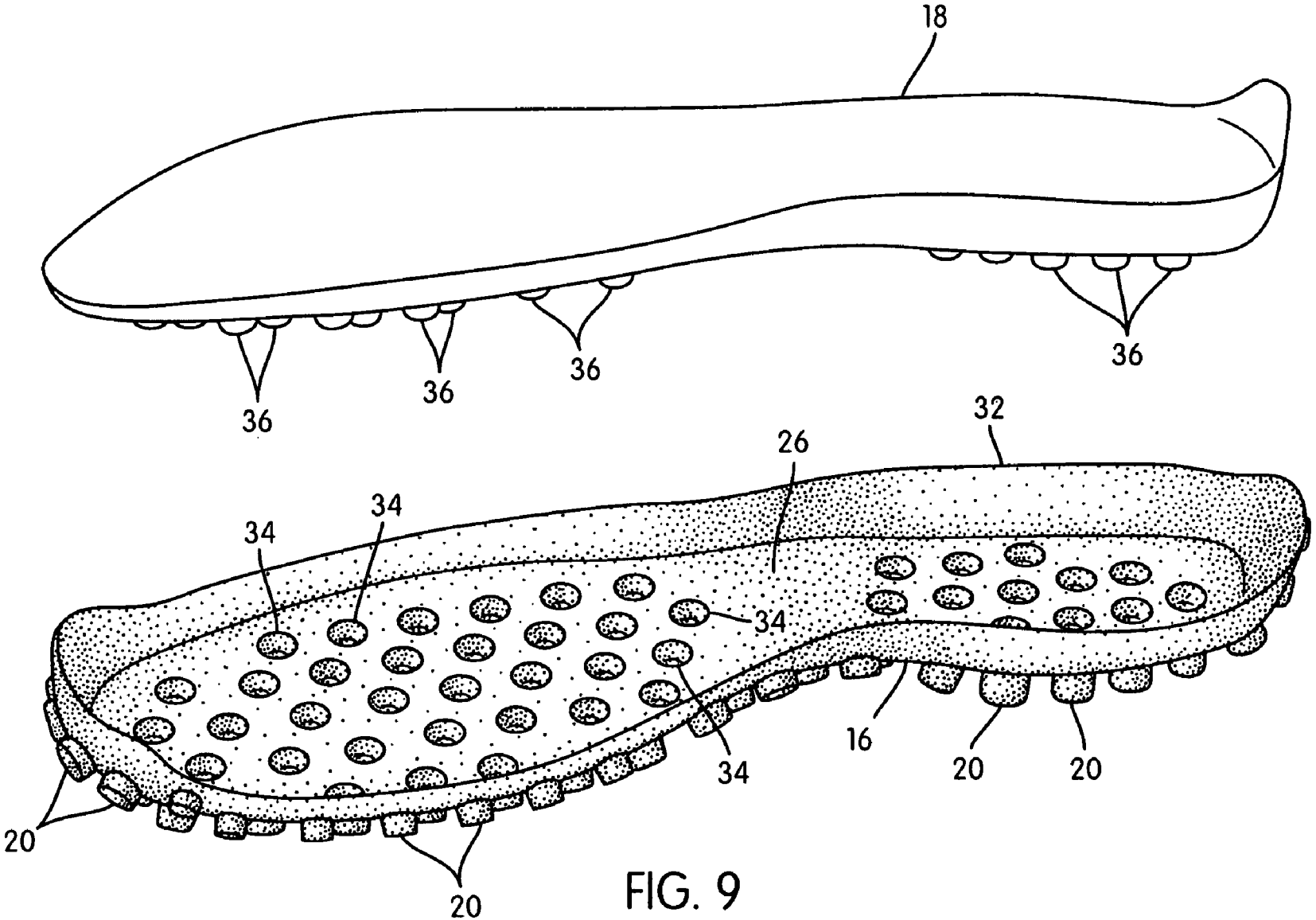
FIG. 9 is an upper perspective "exploded" view of the insole and outsole components of the shoe of FIG. 1.
Figure 10:
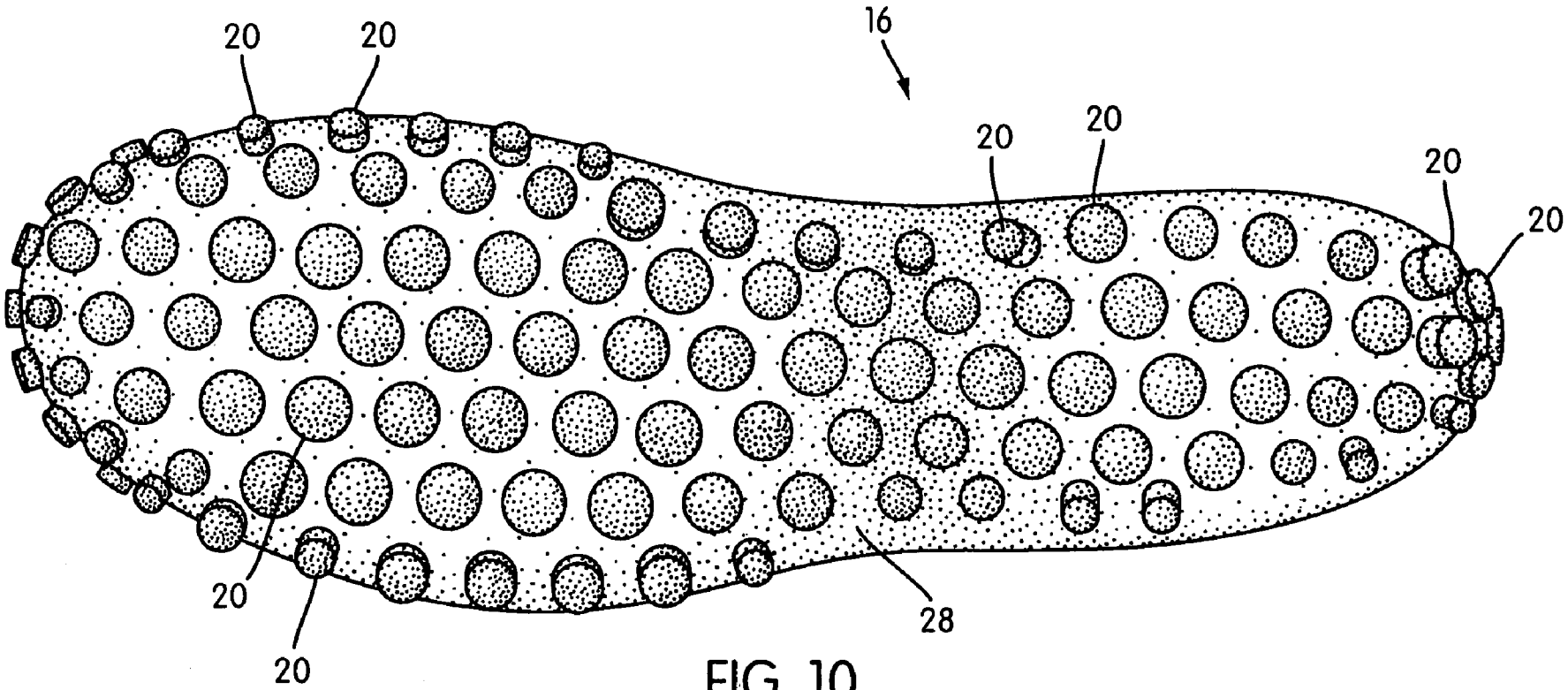
FIG. 10 is a bottom view of the outsole component of the shoe of FIG. 1.
Figure 11:
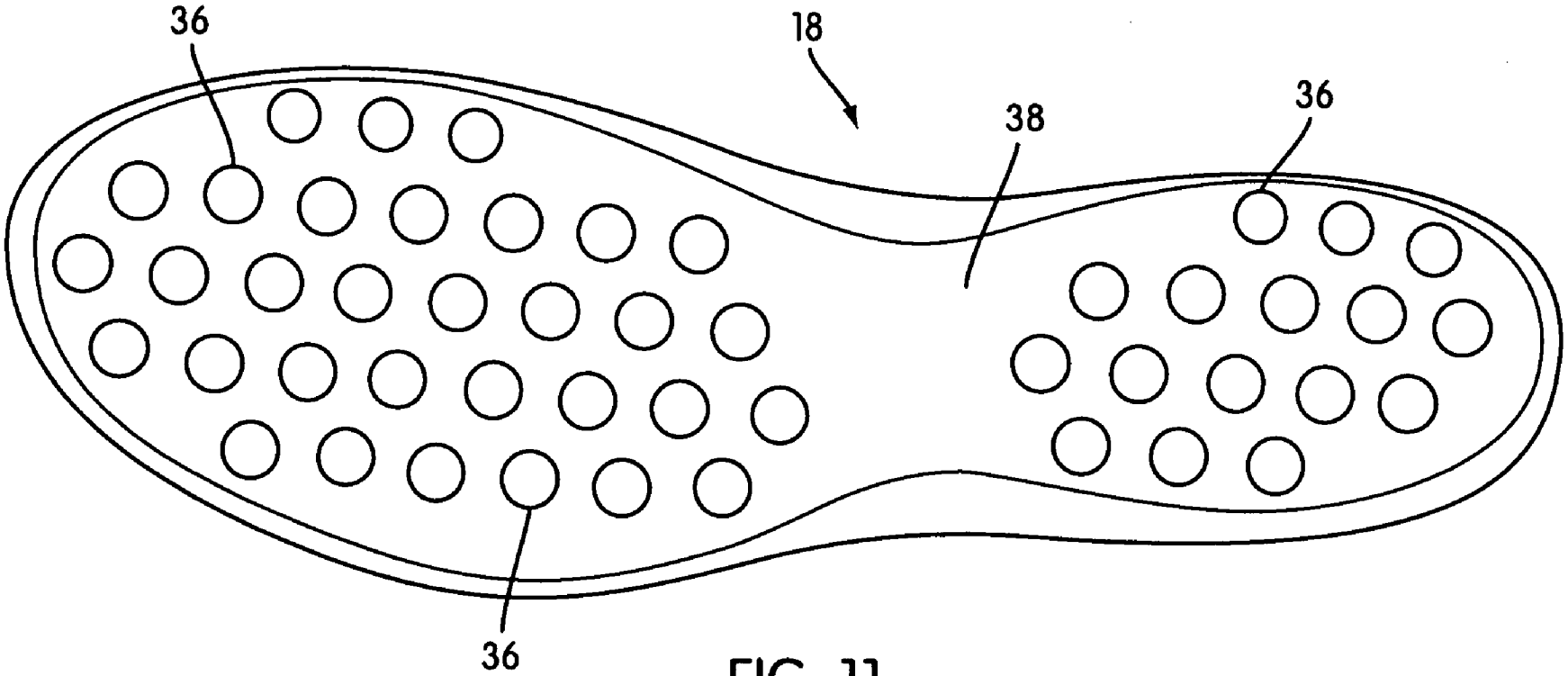
FIG. 11 is a bottom view of the insole component of the shoe of FIG. 1.

FIG. 9 is an upper perspective "exploded" view of outsole 16 and insole 18. Outsole 16 has an upper surface 26 and a lower surface 28 (FIG. 10). Except for lugs 20, lower surface 28 contacts the inner sole region of cage 12. A plurality of downwardly extending lugs 20 are distributed throughout lower surface 28. When outsole 16 is placed within cage 12, lugs 20 protrude through corresponding apertures 22 in cage 12. The tips of lugs 20 then contact the ground when a wearer walks, providing traction. In some embodiments, only lugs 20 contact the ground when a wearer walks on a relatively hard surface. In other embodiments, both lugs 20 and portions of the outer sole region of cage 12 contact the ground when a wearer walks on a relatively hard surface. Lugs 20 and the corresponding apertures 22 through which those lugs protrude are relatively sized such that a user, when assembling shoe 10, may push lugs 20 through their corresponding apertures by exerting moderate force upon the upper surface 26 of outsole 16. The lugs are then frictionally retained by the peripheral edges of the respective apertures 22 through which they protrude. In some embodiments, the entire lower surface 28 has lugs 20 formed thereon. In other embodiments, lugs 20 may be formed on less then the entire lower surface, e.g., some parts of the lower surface may be smooth or otherwise lug-free. In the embodiment shown, lugs 20 are circular in shape and of several diameters. In at least some embodiments, lugs 20 range in diameter from about 6.0 mm to about 13.0 mm. In other embodiments, lugs 20 range in diameter from about 5.4 mm to about 11.7 mm, while in still other embodiments lugs 20 range in diameter from about 6.6 mm to about 14.3 mm. In yet other embodiments, lugs 20 may have other diameters. In embodiments having non-circular lugs, dimensions providing similar lug tip surface area could be used, but rounded, pointed and other types of lug tips are also within the invention. In various embodiments, outsole 16 has about 104 lugs. In other embodiments, outsole 16 may have about 90 to about 95 lugs, while other embodiments may have about 110 to about 115 lugs. Still other embodiments may have other numbers of lugs. The lugs need not be arranged in a regular pattern. To provide additional support to the wearer, certain lugs 20 in the heel region of lower surface 28 are slightly higher than lugs located elsewhere on lower surface 28. In at least some embodiments, lugs 20 range in height (measured from where the lug intersects lower surface 28 to the ground-contacting surface of the lug) from about 3.0 mm to about 8.5 mm. In some embodiments, lugs 20 range in height from about 2.7 mm to about 7.7 mm. In other embodiments, lugs 20 range in height from about 3.3 mm to about 9.4 mm. Still other embodiments may have lugs of other heights.

As indicated above, lugs 20 may have other shapes and/or sizes in other embodiments. FIG. 20 shows two examples of alternate embodiments. The left side of FIG. 20 shows a bottom view of the heel region of a shoe 10' according to another embodiment of the invention. Cage 12' of shoe 10' has a plurality of square apertures 22' through which square lugs 20' protrude. The right side of FIG. 20 shows a bottom view of the mid-foot and toe regions of a shoe 10" according to yet another embodiment of the invention. Cage 12" of shoe 10" has a plurality of hexagonal apertures 22" through which hexagonal lugs 20" protrude. In certain embodiments, there may be more than one shape for lugs 20. In embodiments having lugs of different size and/or shape, the corresponding holes in cage 12 could similarly have different sizes and/or shapes.

As seen in FIG. 9, outsole 16 has a lip 32 surrounding upper surface 26. In some embodiments, lip 32 is slightly larger in the toe and heel regions. As described in more detail below, cage 12 and outsole 16 may be worn without slipper 14. In such a configuration, the raised toe and heel regions can provide additional protection to the wearer. Distributed across upper surface 26 are multiple depressions 34. Depressions 34 correspond to protrusions 36 on lower surface 38 (FIG. 11) of insole 18. In one configuration, insole 18 nests within the region of outsole 16 formed by upper surface 26 and lip 32. In this configuration, protrusions 36 fit within depressions 34.

In at least one embodiment, outsole 16 is molded from a wear-resistant material such as compression-molded rubber. Preferably, outsole 16 is formed from a single material. In certain embodiments, however, outsole 16 may be formed from multiple materials (e.g., a more wear-resistant material could be used for the ground-contacting tips of lugs 20 and a more pliable material used for other portions of the outsole). In at least one embodiment, insole 18 is molded from polyurethane.

Figure 12:
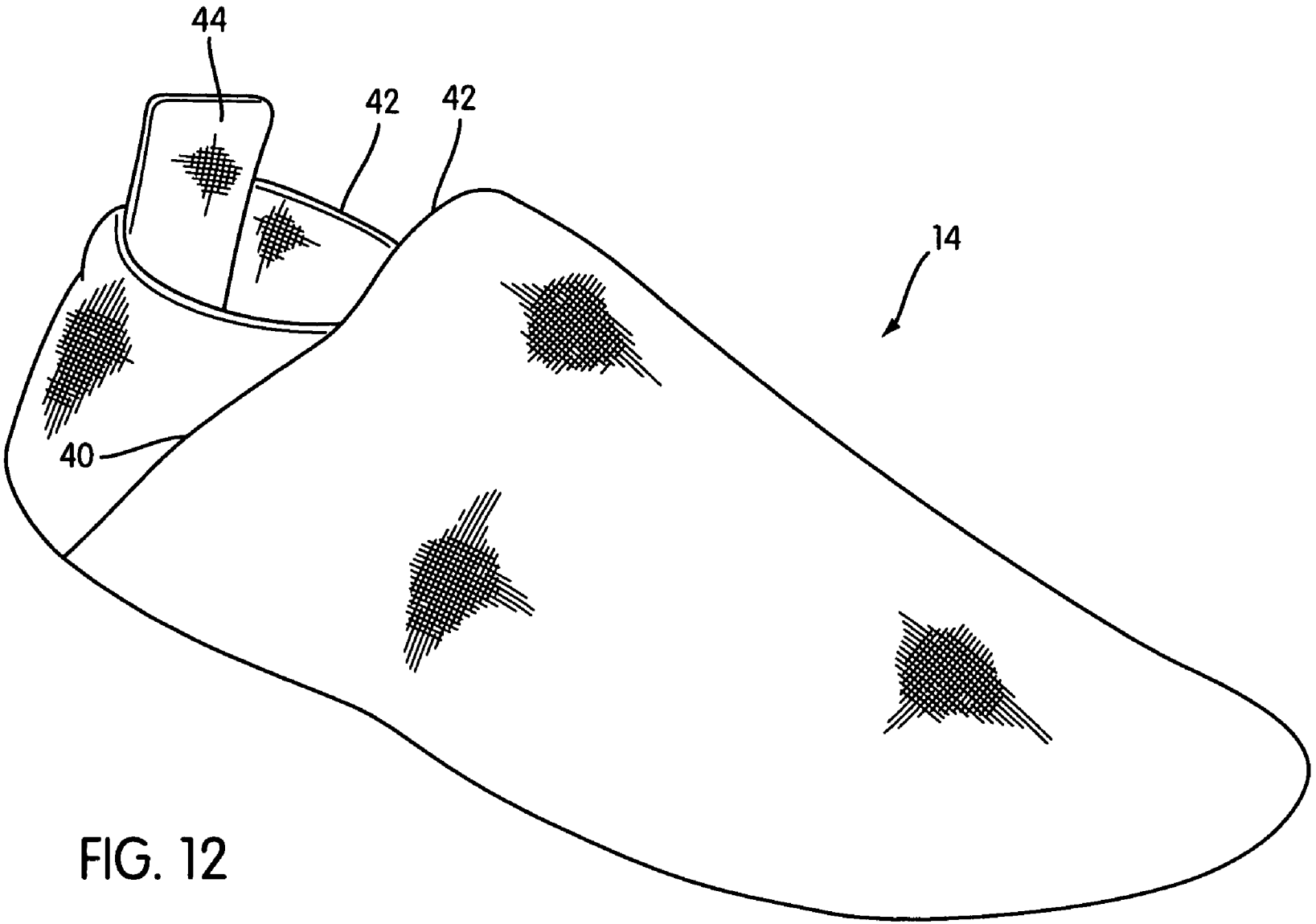
FIG. 12 is a perspective view of the slipper component of the shoe of FIG. 1.
Figure 13:
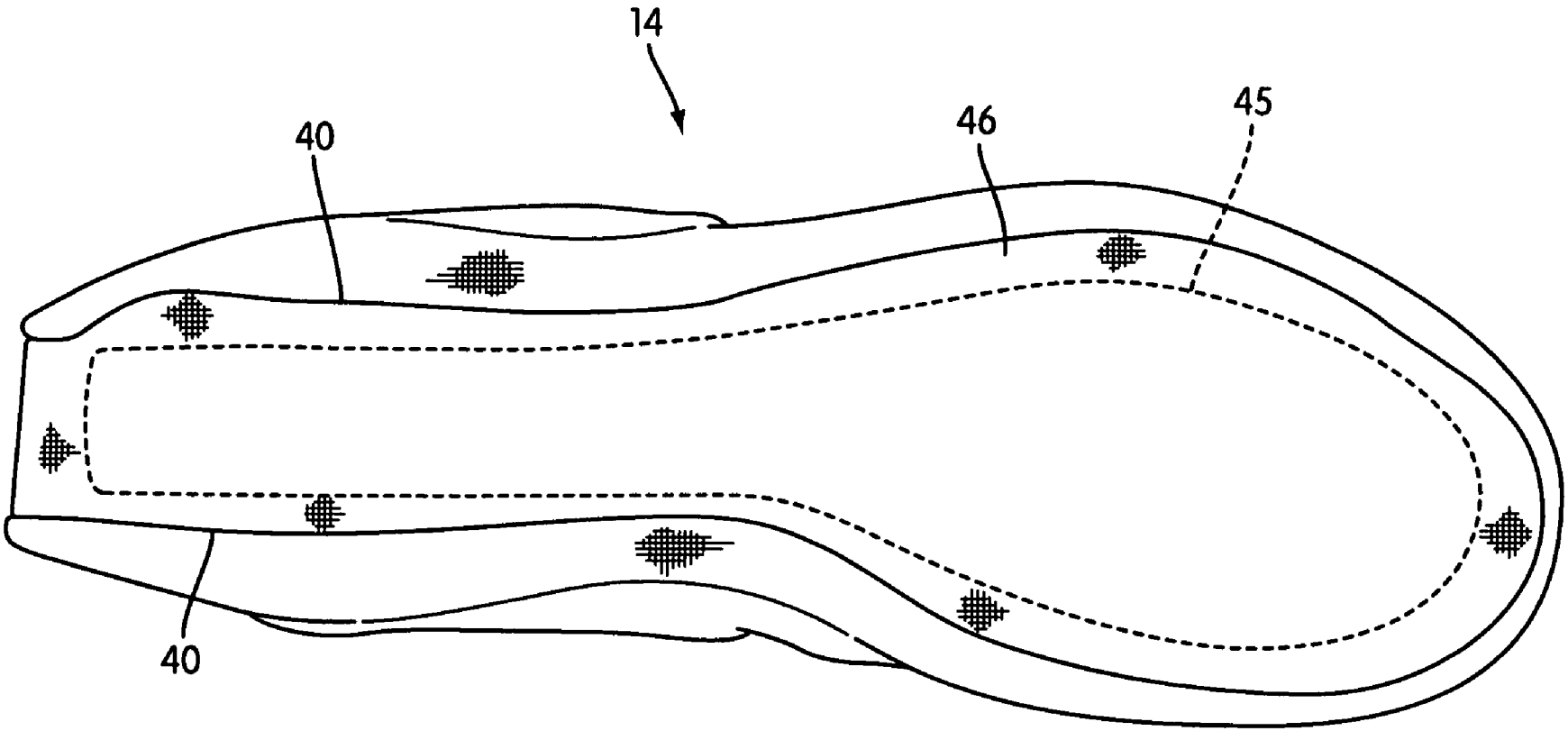
FIG. 13 is a bottom view of the slipper component of the shoe of FIG. 1.

FIG. 12 is an upper perspective view of slipper 14. In one embodiment, slipper 14 is formed a textile material. In some embodiments, one or more fabrics commonly used to form "bootie" shoe components are used. In certain embodiments, an expandable textile such as LYCRA (available from Dupont of Wilmington, Del.) or a LYCRA/neoprene combination are used. In some embodiments, slipper 14 is formed by wrapping one or more sheets of material around a last or other form and joining at one or more seams 40. Seams 40 are joined by stitching, RF welding or other suitable technique. In some embodiments, the ankle collar 42 is sealed and/or stitched. A heel tab 44 is attached by stitching, RF welding, gluing or other suitable technique. Heel tab 44 may be formed from leather or similar material, and may include a strip (not shown) extending to the sole of slipper 14. In other embodiments, no heel tab is included, and only a strip of leather or similar material is attached to the rear side of the slipper. FIG. 13 is a bottom view of slipper 14. In certain embodiments, an additional traction pad 45 (shown in broken lines) may be attached to lower surface 46 so as to provide traction when walking on a slick indoor surface, as well as to prevent premature wear of lower surface 46. Materials for such a traction pad include rubber-coated textile. In other embodiments, lower surface 46 is formed from a rubber-coated textile, or from some other durable and/or high friction material. In still other embodiments, laser etching is implemented to form a traction pad from the material in lower surface 46.

Various combinations of cage 12, outsole 16, slipper 14 and insole 18 provide a wearer with footwear suitable for different circumstances. In one configuration shown in FIG. 14, a person may wear cage 12 alone. The configuration of FIG. 14 is useful in beach or other aquatic environments where the wearer requires some degree of sole protection and/or traction, or requires some protection for the upper part of the foot, but where apertures 22 could permit sand and other material to be easily washed from inside cage 12.

In the configuration of FIG. 15, a person may wear cage 12 with outsole 16. The configuration of FIG. 15 includes at least two variations. In one variation, outsole 16 could be included inside cage 12 without insole 18. In another variation, insole 18 could also be included with cage 12 and outsole 16 (again, without slipper 14) if, e.g., the wearer desires more support in the sole region. The configuration of FIG. 15 could also be useful in beach or other aquatic environments, but in which the wearer may require additional support, sole protection and/or traction. The configuration of FIG. 15 is also suitable for use as a sandal type shoe.

Figure 16:
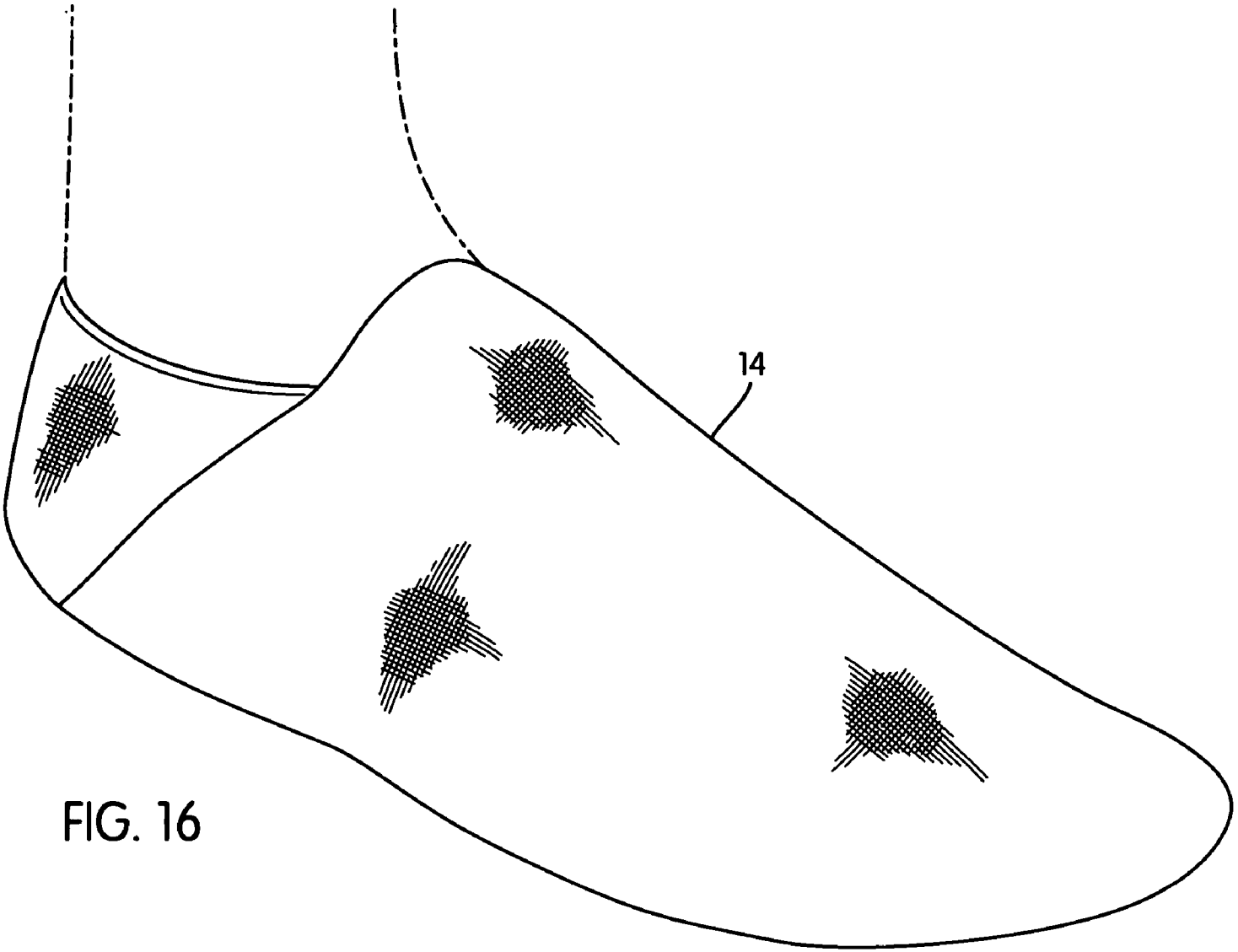
FIG. 16 is an upper perspective view of the slipper component of the shoe of FIG. 1, with a wearer's foot shown in broken lines.

In the configuration of FIG. 16, a person may wear slipper 14 without cage 12 or outsole 16. In this configuration, insole 18 may or may not be inserted inside slipper 14. The configuration of FIG. 16 is suitable for, e.g., indoor wear. Another configuration is shown in FIG. 17. In this configuration, slipper 14 (with or without insole 18 inside) is worn with cage 12 and without outsole 16.

Figure 18:
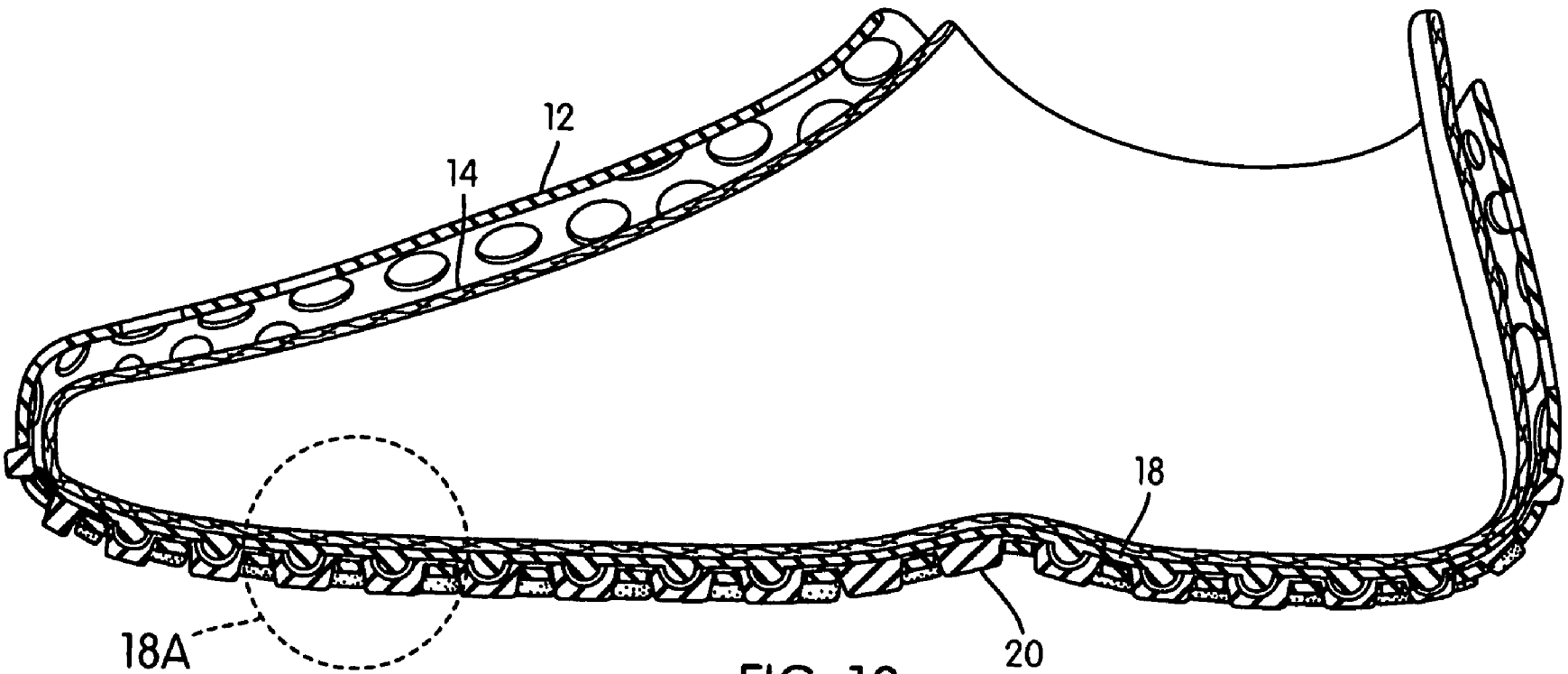
FIG. 18 is a medial cross-section of a fully assembled shoe in a first configuration.
Figure 18A:
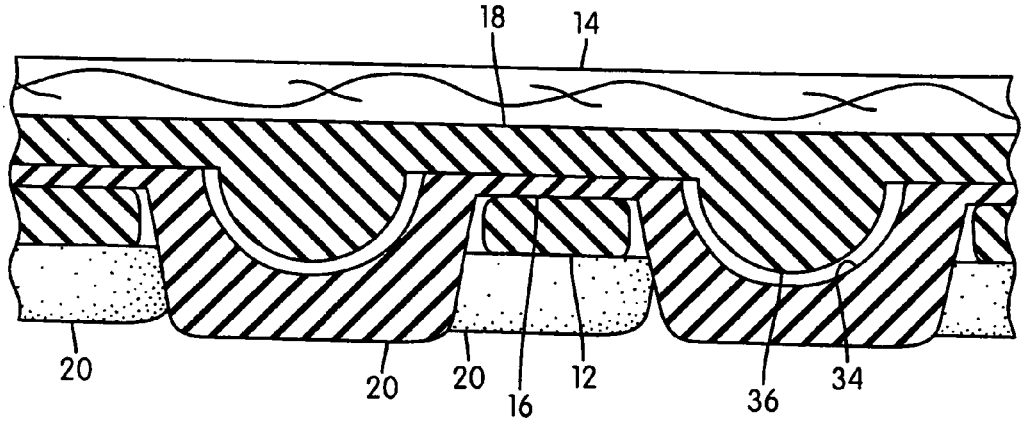
FIG. 18A is an enlarged portion of the cross-section of FIG. 18.

FIG. 18 is a cross section of shoe 10 in one fully-assembled configuration. In the configuration of FIG. 18, outsole 16 rests on the inner sole region of cage 12. Lugs 20 protrude through apertures 22 in the sole region of cage 12. A limited number of lugs 20 also protrude through apertures 22 that are on or near the interface of the sole and upper regions of cage 12. Insole 18 is nested directly on outsole 16, with protrusions 36 resting in corresponding depressions 34. For clarity, a small space is shown between each protrusion 36 and corresponding depression 34 in FIGS. 18 and 18A. In some embodiments, however, protrusions 36 and corresponding depressions 34 may be in contact. The lower surface 46 of slipper 14 then rests on insole 18. FIG. 18A is an enlarged portion of the cross section of FIG. 18, and shows the relative arrangement of cage 12, outsole 16, insole 18 and slipper 14. In at least some embodiments, depressions 34 are generally aligned with corresponding lugs 20 (as shown in FIGS. 18 and 18A). In other embodiments, some or all of depressions 20 do not align with corresponding lugs.

Figure 19:
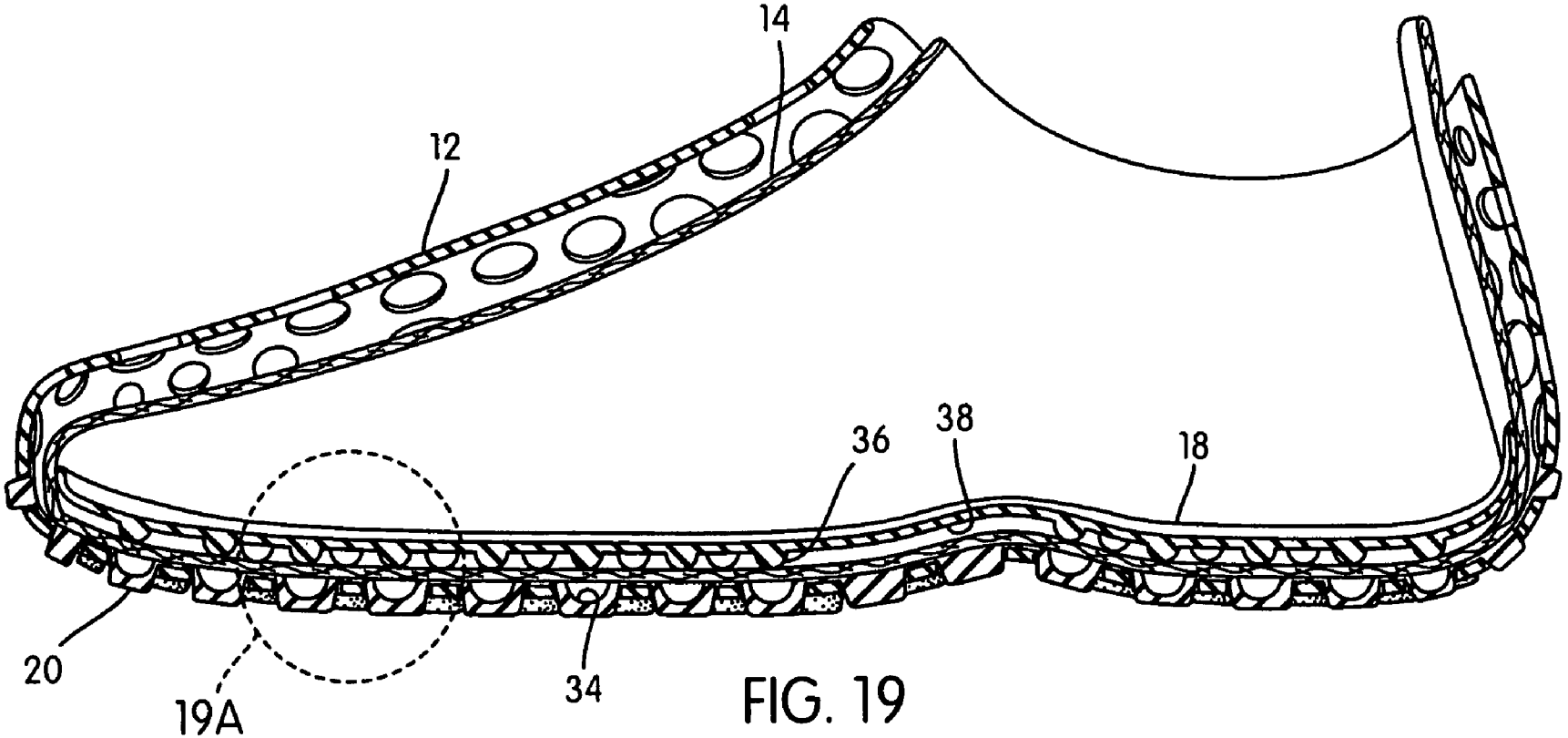
FIG. 19 is a medial cross-section of a fully assembled shoe in a second configuration.
Figure 19A:
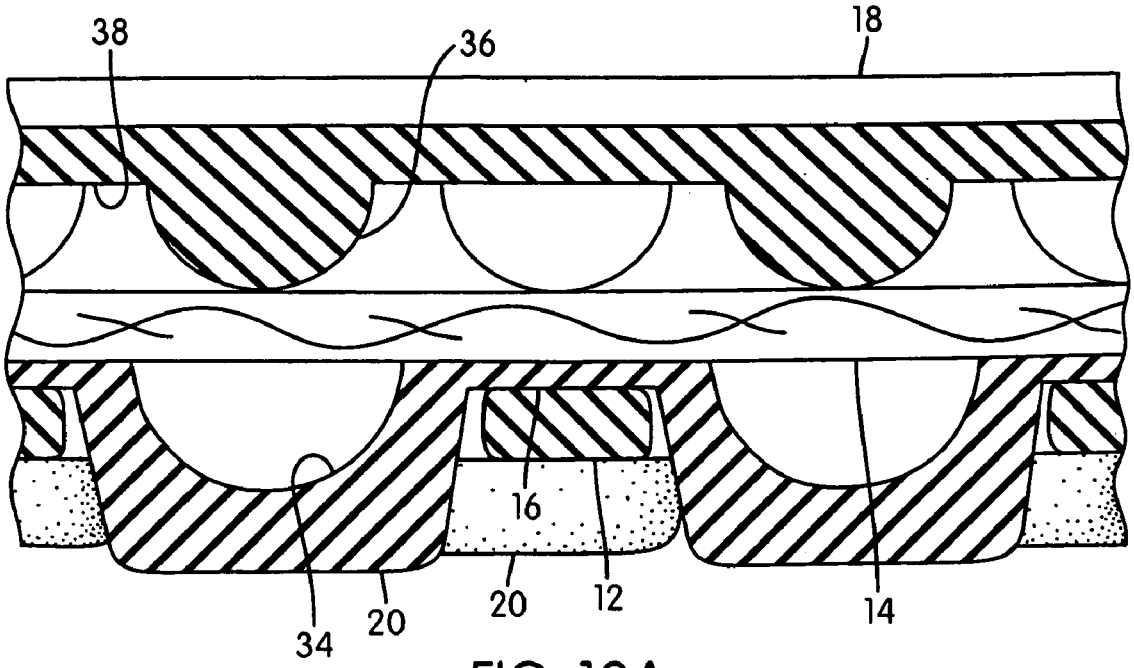
FIG. 19A is an enlarged portion of the cross-section of FIG. 19.

FIG. 19 is a cross section of shoe 10 in an alternate fully-assembled configuration. The configuration of FIG. 19 is generally similar to that of FIG. 18, except that insole 18 is contained within slipper 14. In other words, the lower surface 46 of slipper 14 rests directly on upper surface 26 of outsole 16. In the configuration of FIG. 19, the weight of a wearer (not shown) causes protrusions 36 on insole 18 to push the material of slipper 14 into depressions 34 of outsole 16. This helps secure slipper 14 relative to outsole 16 and cage 12. FIG. 19A is an enlarged portion of the cross section of FIG. 19, and shows the relative arrangement of cage 12, outsole 16, slipper 14 and insole 18.

In some embodiments, some or all of the components of shoe 10 are fabricated so as to facilitate recycling at the end of the shoe's useful life. Specifically, cage 12 is made from a first material (or combination of materials with similar recycling requirements) and outsole 16 is made from a second material (or combination of materials with similar recycling requirements). Insole 18 is also made from a single material (or combination of materials with similar recycling requirements), which may or may not be the same as that of outsole 16. In some embodiments, slipper 14 may also be formed from a single material or from a combination of materials with similar recycling requirements. In this manner, the components of shoe 10 can be readily separated for recycling. In other embodiments, one or more of cage 12, slipper 14, outsole 16 and insole 18 is made from multiple materials which may not have similar recycling requirements.

As previously indicated, each component may be manufactured in a variety of alternate embodiments. For example, embodiments of shoe 10 intended for lighter uses (and/or certain wearer preferences) could include a cage 12 formed from a first material that is more flexible and less wear resistant than would an embodiment intended for more rugged use (and/or other wearer preferences). Similarly, outsole 16 could be manufactured from a softer material for certain intended uses and/or wearer preferences, and/or have lugs that are smaller, shorter and/or less numerous. For more rugged conditions (and/or other wearer preferences), outsole 16 could be made from harder material and/or have larger, higher and/or more numerous lugs. Insole 18 could also be made from multiple materials depending upon the intended use(s) of the shoe or wearer preference (e.g., some wearers may prefer a softer insole, while others may prefer a harder insole). Different shapes (e.g., orthotic surfaces to closely support the foot) could also be incorporated. Slipper 14 could be made from a thinner, more lightweight material for warm weather uses, from a thicker and/or warmer material for cold weather uses, from more durable material if the shoe will primarily be worn outdoors, from a less durable but more stylish material if the shoe will predominantly be worn indoors, from different materials based on wearer preferences, etc. Cage 12, outsole 16 and/or insole 18 may be transparent, translucent or opaque, and may be manufactured in different colors. Similarly, slipper 14 may also be manufactured in a variety of colors.

Because the various components of shoe 10 can be removed and recombined as desired, components from different shoes can be further combined. For example, a person may own one pair of shoes 10 having a thicker cage 12 with no apertures in the upper, an outsole 12 with relatively long lugs, and a slipper that is made from a cold weather material. The person may then own another pair of shoes 10 having a thinner cage 12 with apertures in the upper, an outsole 12 with shorter lugs, and a slipper made from warm weather material. The person could then combine various components from the two pairs to obtain an even more specialized pair of shoes. Similarly, a person owning pairs of shoes 10 in different colors could mix components from the pairs to obtain different color combinations.

While particular embodiments of the invention have been shown and described, it is recognized that various modifications thereof will occur to those skilled in the art. Therefore, the scope of the herein-described invention shall be limited solely by the claims appended hereto.

We claim:

1. An article configured for placement on a foot of a human wearer, comprising:

a one-piece flexible outer cover formed of an elastomeric material that retains the cover on the foot, the cover including:

a sole region having opposing inner and outer surfaces, the inner surface positioned to face the sole of the foot, an upper region, and a plurality of apertures formed throughout the entire sole and upper region, wherein each of the plurality of apertures form a generally open area sized from 5.0 mm to 15.0 mm wide; and a removable outsole nested within the cover and including:

opposing upper and lower surfaces, the lower surface facing the inner sole region surface, and a plurality of lugs on the lower surface protruding into the plurality of apertures formed throughout the sole region.

2. The article of claim 1, wherein the plurality of lugs and the plurality of apertures are relatively sized and shaped so that edges of said apertures conform to and frictionally retain said lugs.

3. The article of claim 1, wherein at least a portion of the plurality of lugs protrude through at least a portion of the plurality of apertures, said portion of the plurality of lugs extending beyond the outer sole region surface.

4. The article of claim 1, wherein the cover is shaped to envelope substantially all of the foot below the ankle of the wearer.

5. The article of claim 1, wherein the outer cover is thermoplastic polyurethane.

6. The article of claim 1, further comprising a removable slipper nested within the cover and having a sole and an upper, the slipper sole facing the outsole upper surface.

7. The article of claim 6, wherein the slipper is formed from a textile material.

8. The article of claim 7, wherein the slipper sole comprises a traction surface.

9. The article of claim 6, further comprising a removable insole having opposing upper and lower surfaces, the lower insole surface facing the upper outsole surface.

10. The article of claim 9, wherein:

the lower insole surface includes a plurality of protrusions, and the upper outsole surface has depressions formed therein, the depressions positioned to correspond with and receive the protrusions.

11. The article of claim 10, wherein the insole is sized for alternate placement within the slipper or between the slipper and the outsole.

12. The article of claim 1, further comprising a removable insole having upper and lower surfaces, the lower insole surface facing the upper outsole surface.

13. The article of claim 12, wherein:

the lower insole surface includes a plurality of protrusions, and the upper outsole surface has depressions formed therein, the depressions positioned to correspond with and receive the protrusions.

14. An article configured to be placed on the foot of a human wearer, comprising:

a one-piece flexible outer cover shaped to envelope substantially all of the foot below the ankle of the wearer, the cover being formed of an elastomeric material and including:

a sole region having opposing inner and outer surfaces, the inner surface positioned to face the sole of the foot, an upper region attached to the sole region and positioned to cover at least a portion of the top and sides of the foot, and a plurality of apertures formed in the sole region and upper region, wherein each of the plurality of apertures form a generally open area sized between 5.0 mm and 15.0 mm wide;

a removable outsole nested within the cover and including:

opposing upper and lower surfaces, the lower surface facing the inner sole region surface, and a plurality of lugs on the lower surface protruding into a portion of the plurality of apertures formed throughout the sole region; and a removable slipper nested within the cover and having a sole and an upper, the slipper sole facing the upper outsole surface.

15. The article of claim 14, wherein the slipper is formed from a textile material.

16. The article of claim 14, further comprising a removable insole having upper and lower surfaces, the lower surface facing the upper outsole surface.

17. The article of claim 16, wherein the insole is sized to alternately nest within the slipper or between the slipper and the outsole.

18. The article of claim 17, wherein:

the lower insole surface includes a plurality of protrusions, and the upper outsole surface has depressions formed therein, the depressions positioned to correspond with and receive the protrusions.

* * * * *